US007654941B2

(12) United States Patent
Lacher

(10) Patent No.: US 7,654,941 B2
(45) Date of Patent: Feb. 2, 2010

(54) EXERCISE APPARATUS

(75) Inventor: Mark Lacher, Whitestone, NY (US)

(73) Assignee: Natural Fitness, Inc., Whitestone, NY (US)

( * ) Notice: Subject to any disclaimer, the term of this patent is extended or adjusted under 35 U.S.C. 154(b) by 196 days.

(21) Appl. No.: 11/959,704

(22) Filed: Dec. 19, 2007

(65) Prior Publication Data

US 2009/0163331 A1 Jun. 25, 2009

(51) Int. Cl.
*A63B 21/06* (2006.01)

(52) U.S. Cl. ..... 482/98; 482/83; 482/135

(58) Field of Classification Search ..... 482/71, 482/83, 87, 90, 94, 98, 133–135, 907
See application file for complete search history.

(56) References Cited

U.S. PATENT DOCUMENTS 2,720,396 A * 10/1955 Pfaus ..... 482/130
2,940,757 A * 6/1960 Britt ..... 473/445
4,465,275 A * 8/1984 Lingelbach ..... 482/98
5,122,106 A 6/1992 Atwood et al.
5,273,508 A * 12/1993 Jones ..... 482/136
5,279,530 A * 1/1994 Hess ..... 482/70
5,295,935 A * 3/1994 Wang ..... 482/130
5,328,427 A * 7/1994 Sleamaker ..... 482/71
5,503,609 A * 4/1996 Bull ..... 482/70
5,518,483 A * 5/1996 Oswald ..... 482/131
5,518,484 A * 5/1996 Bruckenstein ..... 482/131
5,665,035 A * 9/1997 Tumminia ..... 482/83
5,810,698 A 9/1998 Hullett et al.
5,913,759 A 6/1999 Bostrom
6,149,554 A * 11/2000 Ferguson ..... 482/83
6,220,996 B1 * 4/2001 McArthur ..... 482/142
6,482,134 B1 11/2002 Rasmussen
6,585,625 B1 * 7/2003 Ferguson ..... 482/83
7,037,244 B2 * 5/2006 Svihra et al. ..... 482/93
7,094,189 B2 8/2006 Fallacaro
7,134,987 B2 * 11/2006 Goldstein ..... 482/141
7,137,936 B1 * 11/2006 Shaw et al. ..... 482/127
7,160,234 B2 1/2007 Dise
7,172,535 B2 * 2/2007 Volmar ..... 482/101
7,229,391 B2 6/2007 Francis
2006/0194677 A1 * 8/2006 Whitall et al. ..... 482/92

* cited by examiner

*Primary Examiner*—Fenn C Mathew
*Assistant Examiner*—Andrew M Tecco
(74) *Attorney, Agent, or Firm*—Gottlieb, Rackman & Reisman

(57) ABSTRACT

An improved exercise apparatus for martial arts is provided and includes a longitudinally extending platform, a support on which the platform rests or is otherwise supported and a plate unit slidably carried along the platform and movable between a first retracted position and a second extended position in response to a force being applied to the plate unit by the leg or arm of an individual during exercise.

17 Claims, 15 Drawing Sheets

FIG. 9
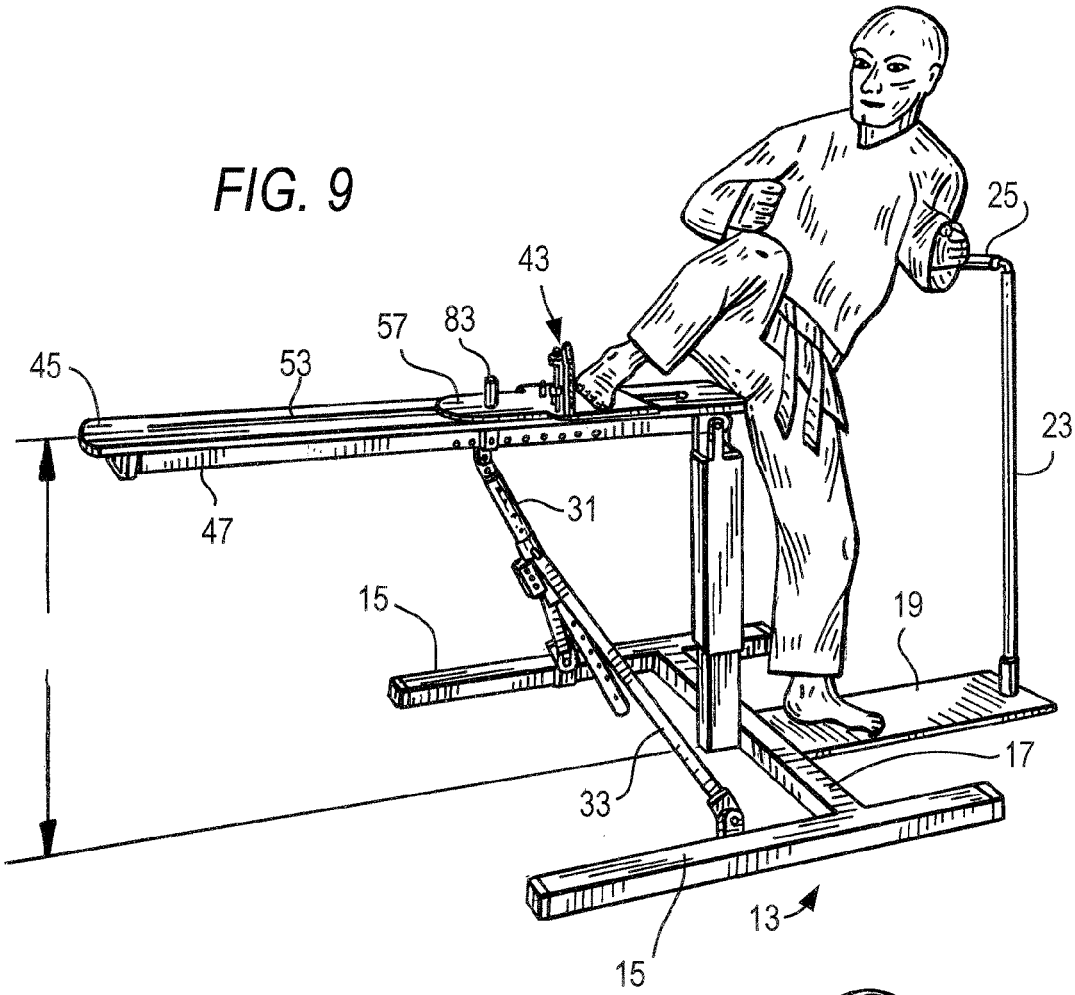
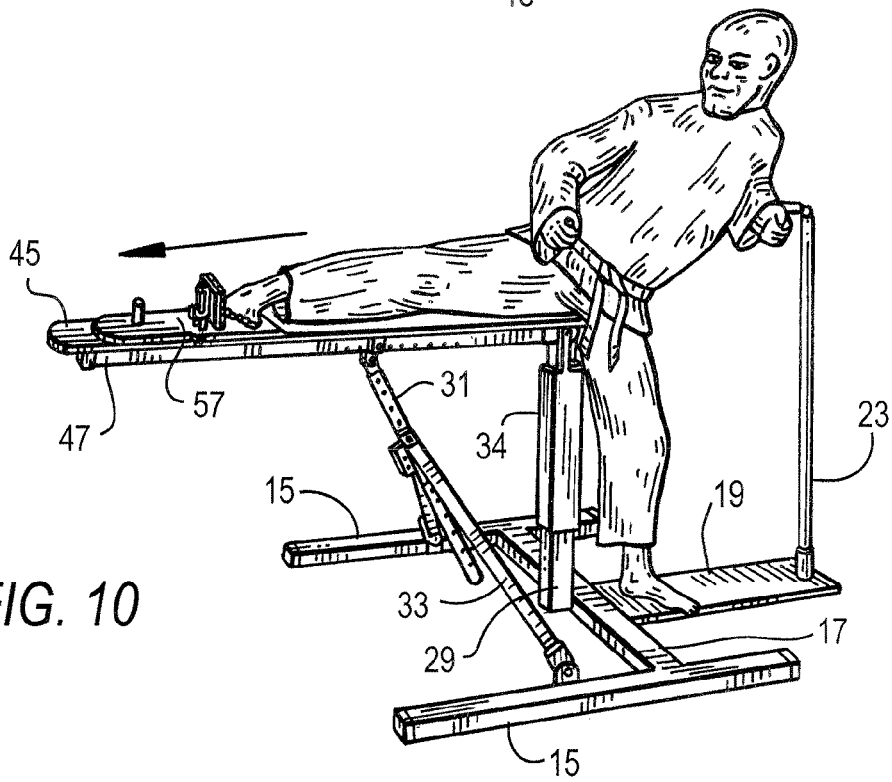
FIG. 10

FIG. 11
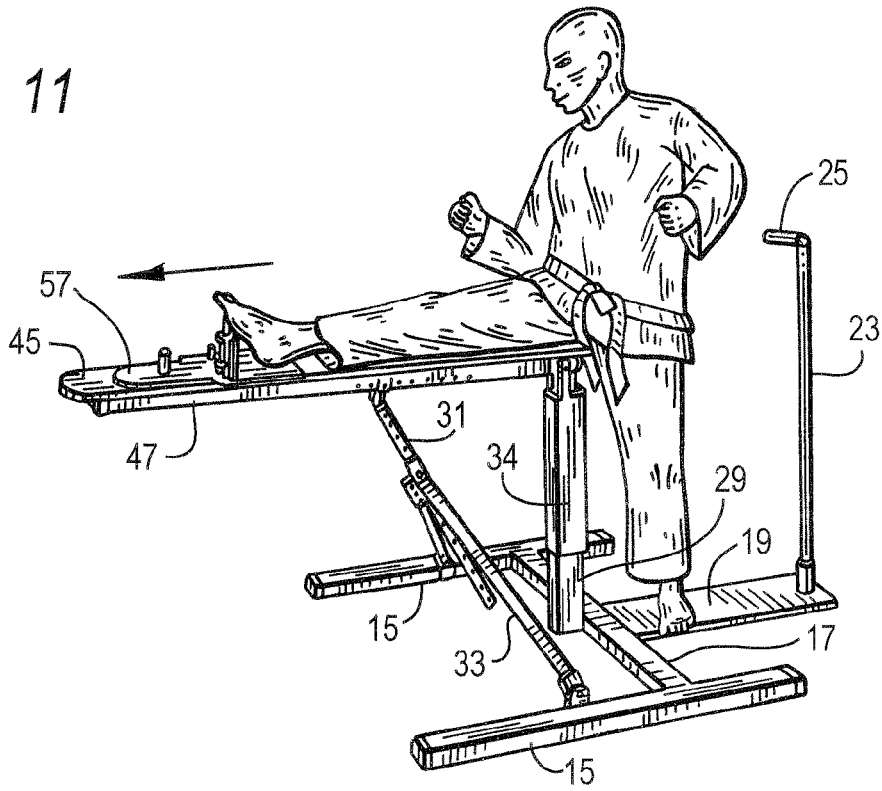
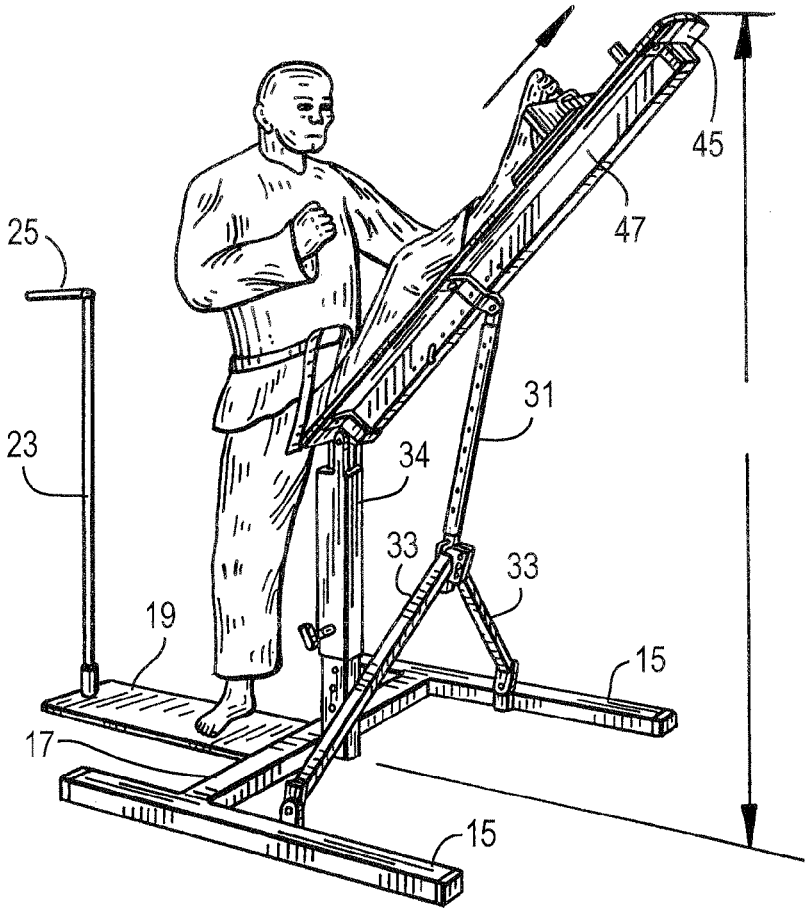
FIG. 12

FIG. 16
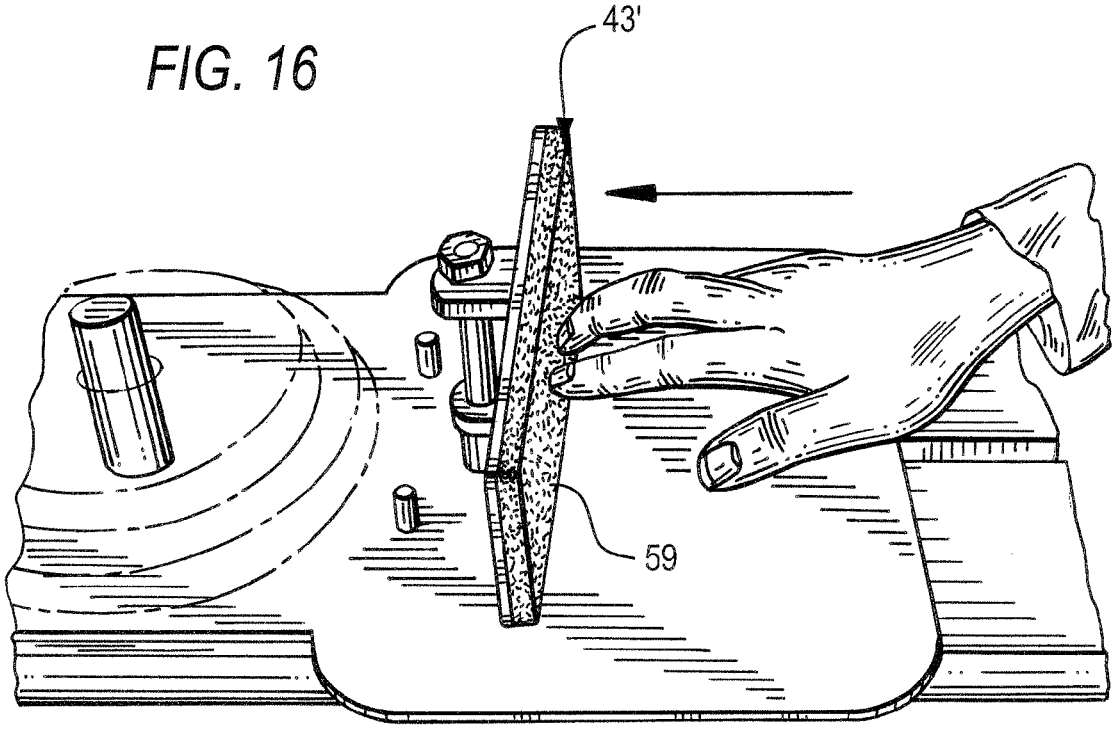
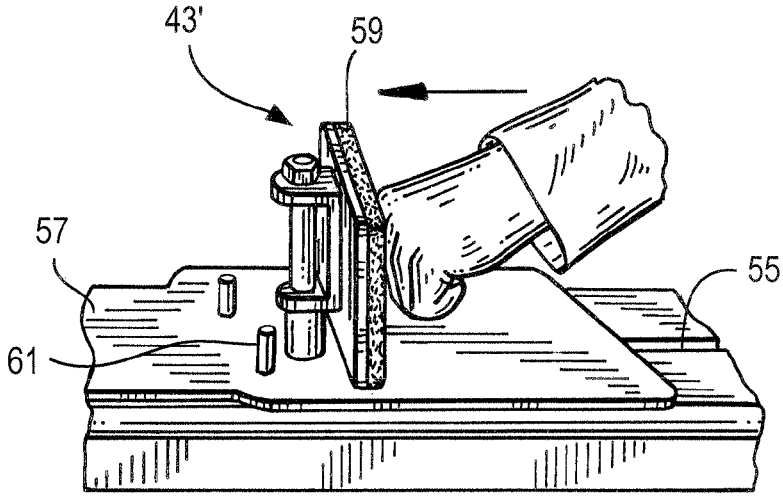
FIG. 17

FIG. 18
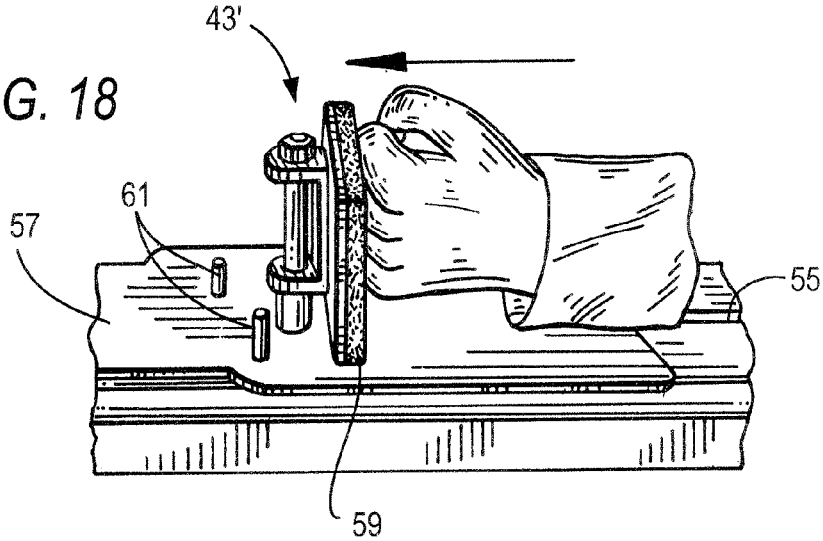
FIG. 19
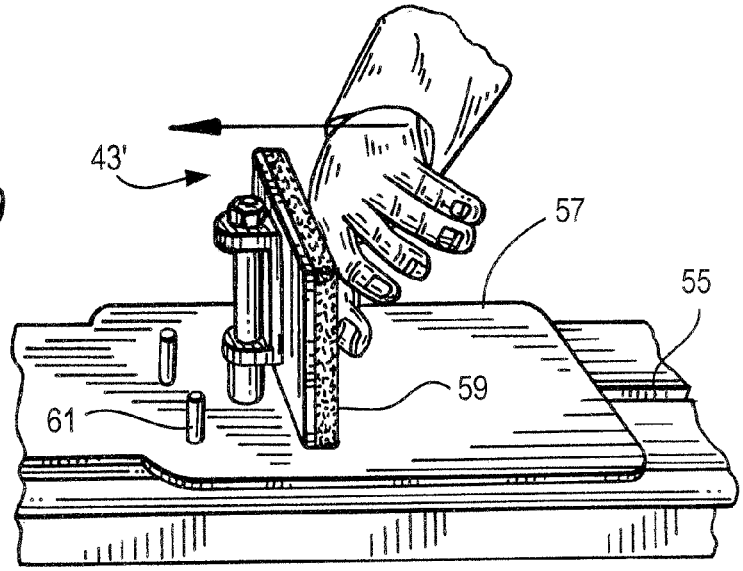
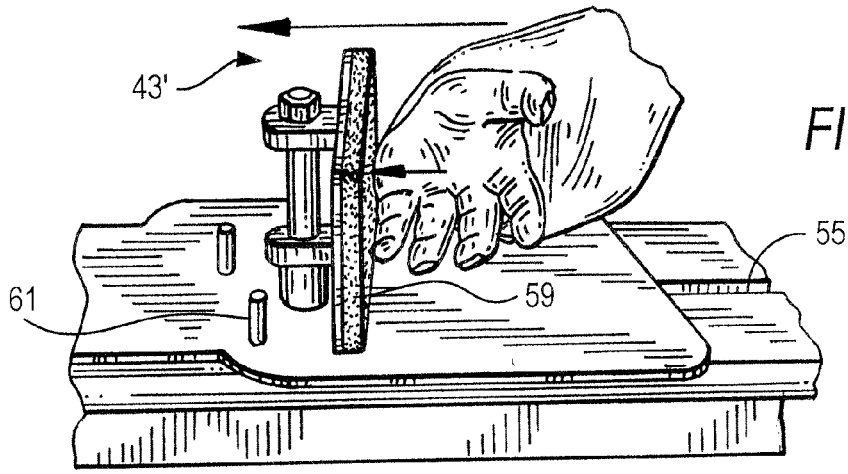
FIG. 20

FIG. 24
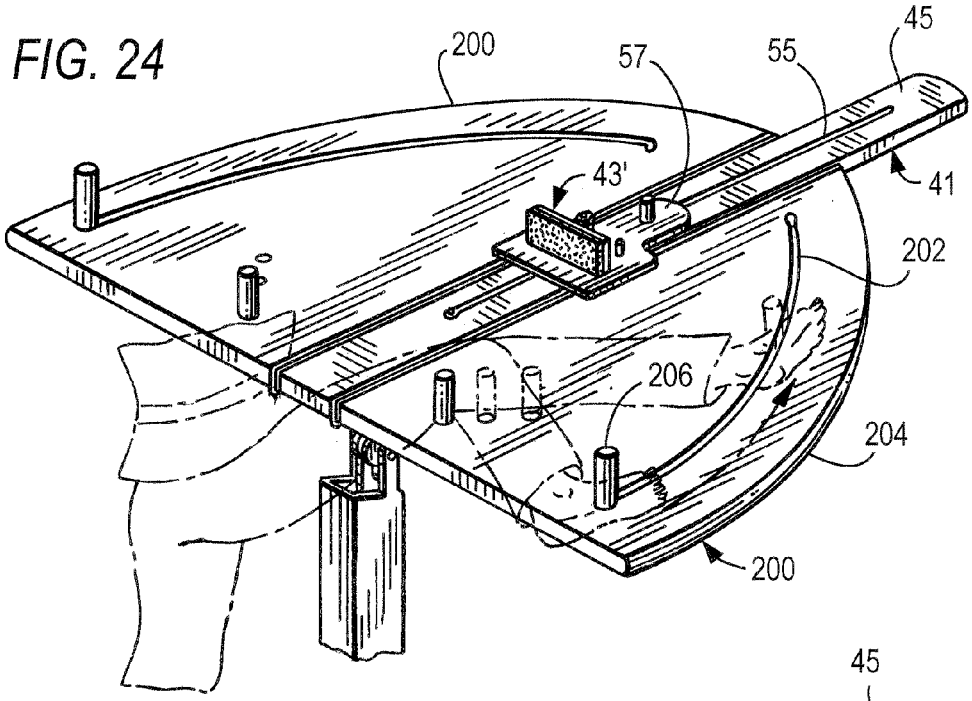
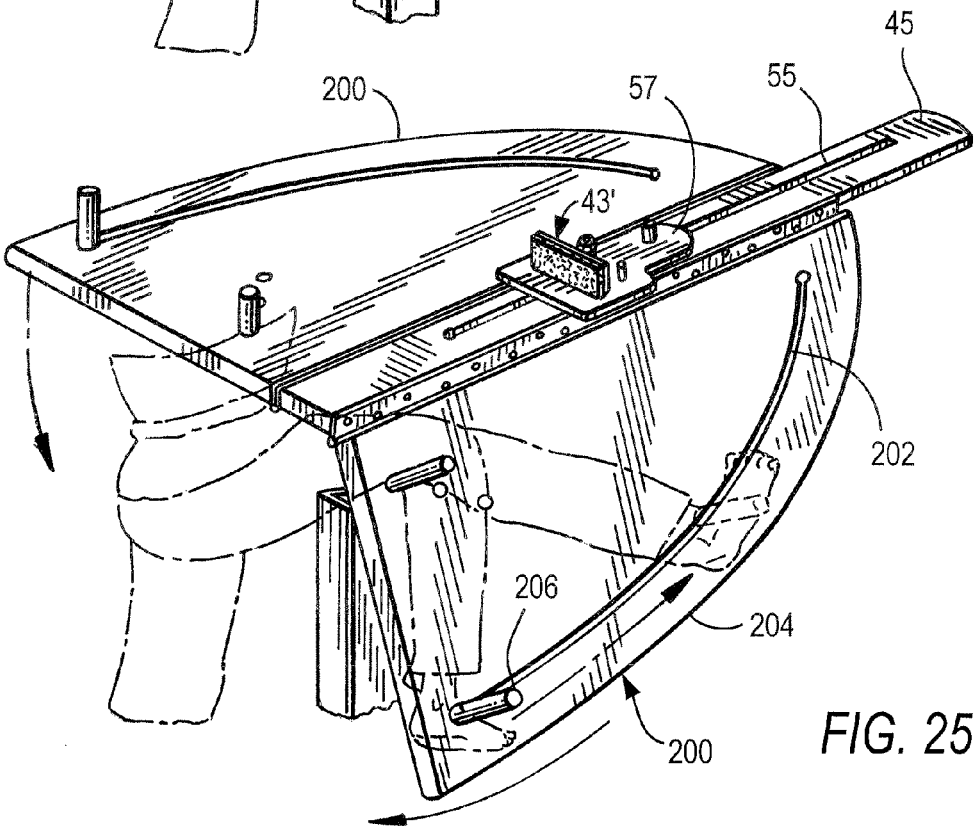
FIG. 25

EXERCISE APPARATUS

BACKGROUND OF THE INVENTION

The inventive exercise apparatus is designed to avoid the risk of injury caused by the current traditional methods of martial arts training. The only way to obtain flexibility in martial arts training was to use stationary objects such as chairs, table tops, stairs etc. In such training, one leg would be held on the object while stretching the other leg. This creates a high risk of injury, imbalance and very slow results.

SUMMARY OF THE INVENTION

Generally speaking, in accordance with the invention, an improved exercise apparatus for martial arts training is provided. The apparatus includes a longitudinally extending platform along which a leg or other body appendage is extendible, a support on which the platform rests or is otherwise supported, and a plate unit slidably carried along the platform and movable between a first retracted position and a second extended position in response to a force being applied to the plate unit by one's leg or other body appendage during exercise.

The support of the inventive exercise apparatus consists of a support bar extending down from one end of the platform and a support frame extending down from the platform at a location away from the support bar. Significantly, both the support bar and the support frame may have their heights selectively and independently adjusted. The support bar is adjustable in height by means of a sleeve that is slidably movable with respect to the support bar. The support frame includes an adjusting bar extending down from the platform and a pair of arms that are slidably connected to the adjusting bar; these arms extend angularly downward from the adjustment bar at a direction away from one another. In a preferred embodiment, the arms of the support frame are slidably connected to the adjustment bar by means of a slidably movable sleeve.

The platform of the inventive exercise apparatus is preferably formed with a running channel through which a wheel assembly for carrying the plate unit is transported in response to a force being applied thereto. In one embodiment, the plate unit is pivotally rotatable in a lateral or longitudinal direction, or in both directions.

In the design of the inventive exercise apparatus, the plate unit includes a base on which a pedal is pivotally supported. In one form, the base includes a mechanism for adding resistance against a force that is applied to the pedal. This mechanism can include either some type of spring member disposed along the platform or a weight element that is added to the base.

In order to ensure that the plate unit is normally in a retracted position, that is, to ensure that the plate is in a retracted position when a force is not applied to the pedal, a counterweight is optionally provided. The counterweight is preferably disposed within the support bar of the support.

An optional feature of the inventive exercise apparatus is having the platform being pivotally rotatable from side to side.

Accordingly, it is an object of the invention to provide an improved exercise apparatus for martial arts training.

Another object of the invention is to provide an exercise apparatus for promoting muscle stretching during martial arts training.

A further object of the invention is to provide an improved exercise apparatus which is also suitable for stretching one's leg muscles.

Yet another object of the invention is to provide an improved exercise apparatus for martial arts training which improves flexibility while substantially eliminating the risk for injury.

Other objects and advantages of the invention will, in part, be obvious and will, in part, be apparent from the following description.

The invention accordingly comprises the features of construction, combination of elements and arrangements of parts which will be exemplified in the construction hereinafter set forth, and the scope of the invention will be indicated in the claims.

BRIEF DESCRIPTION OF THE DRAWINGS

For a fuller understanding of the invention, reference is made to the following description, taken in connection with the accompanying drawings, in which:

FIGS. 8-14 are perspective views in elevation showing various leg exercises that can be carried out using the inventive exercise apparatus;

FIGS. 16-20 are perspective views of a portion of the inventive apparatus in which various hand/arm exercises may be carried out;

FIG. 24 is a perspective view of the optional feature of a pair of wing elements hinged on either side of the platform unit; and FIG. 25 is similar to FIG. 24 and shows one of the hinged wing elements being disposed in a hanging condition.

DETAILED DESCRIPTION OF THE INVENTION

Figure 1:
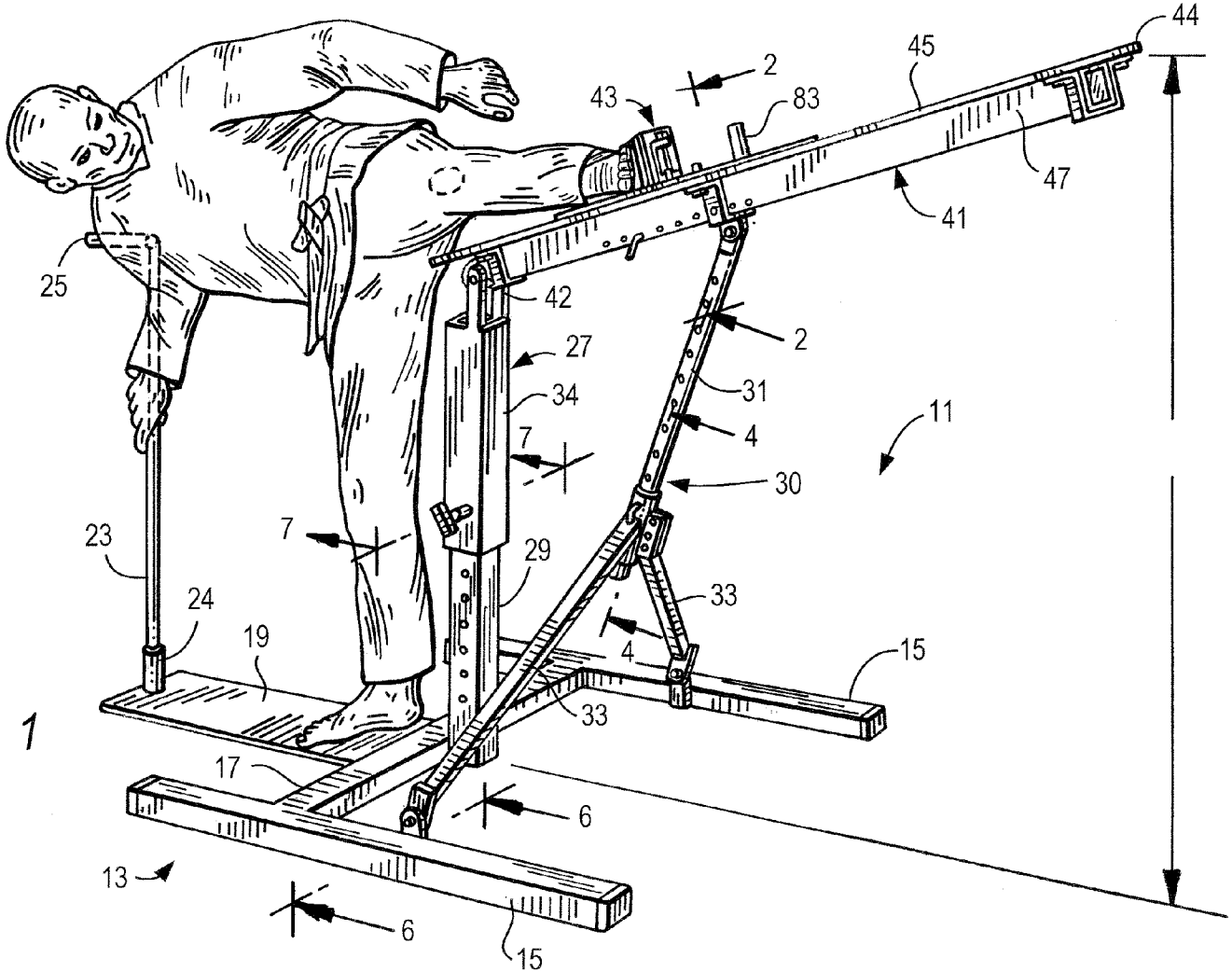
FIG. 1 is an overall perspective view of the inventive exercise apparatus.

Referring first to FIG. 1, the exercise apparatus of the invention is generally indicated at 11 and includes a longitudinally extending platform unit 41, a support unit 27 extending downwardly from one end of platform unit 41, a support frame 30 extending downwardly from platform unit 41 midway therealong and a base unit 13 for supporting support frame 30. Platform unit 41 has a first rearward end 42 pivotally hinged to support unit 27 and a second forward end 44. Platform unit 41 includes a longitudinally extending top or base 45 along which a kick plate assembly 43 slidably rides therealong and an underlying longitudinally extending and rectangularly configured housing 47.

Figure 2:
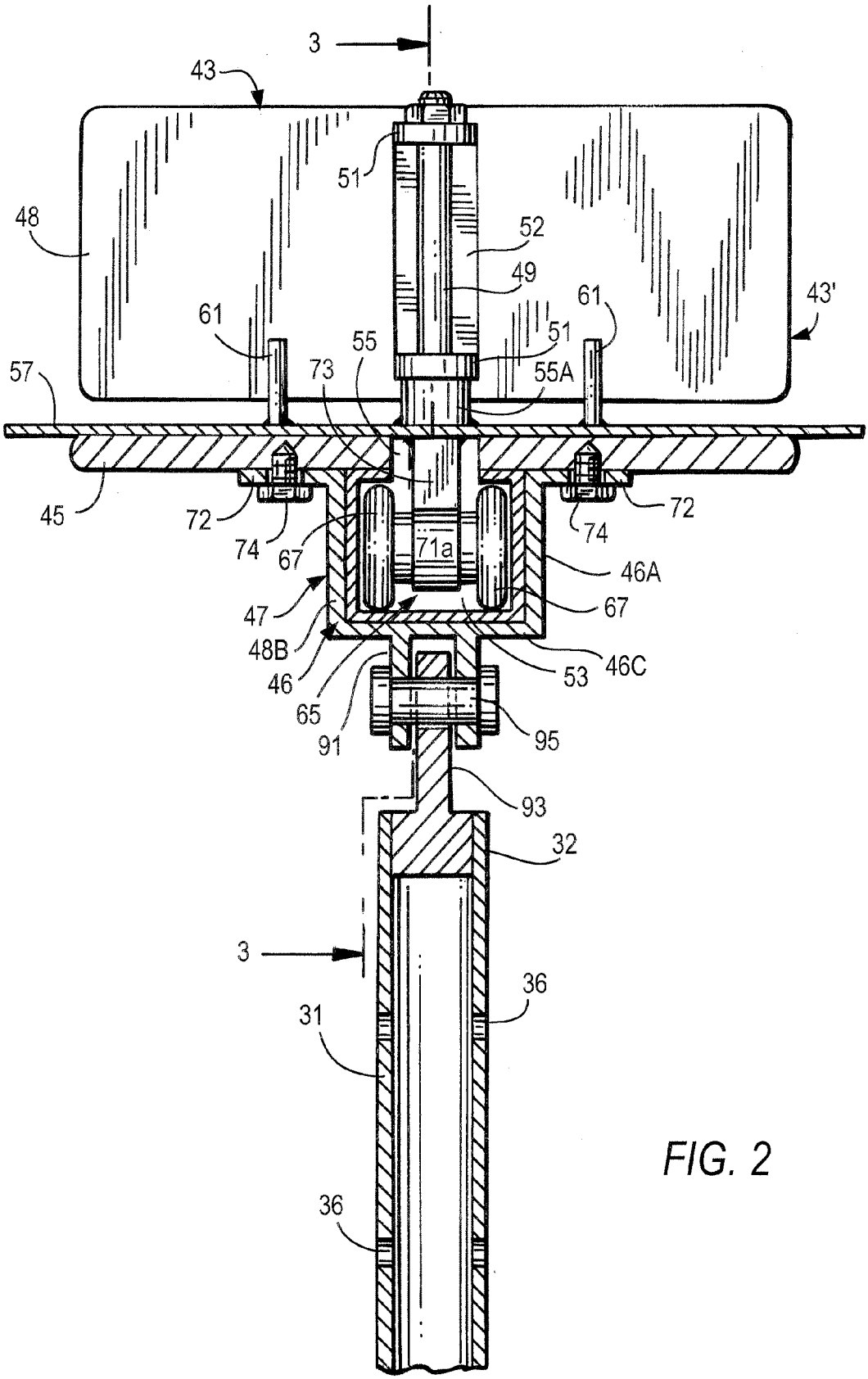
FIG. 2 is a cross-sectional view taken along line 2-2 of FIG. 1.
Figure 3:
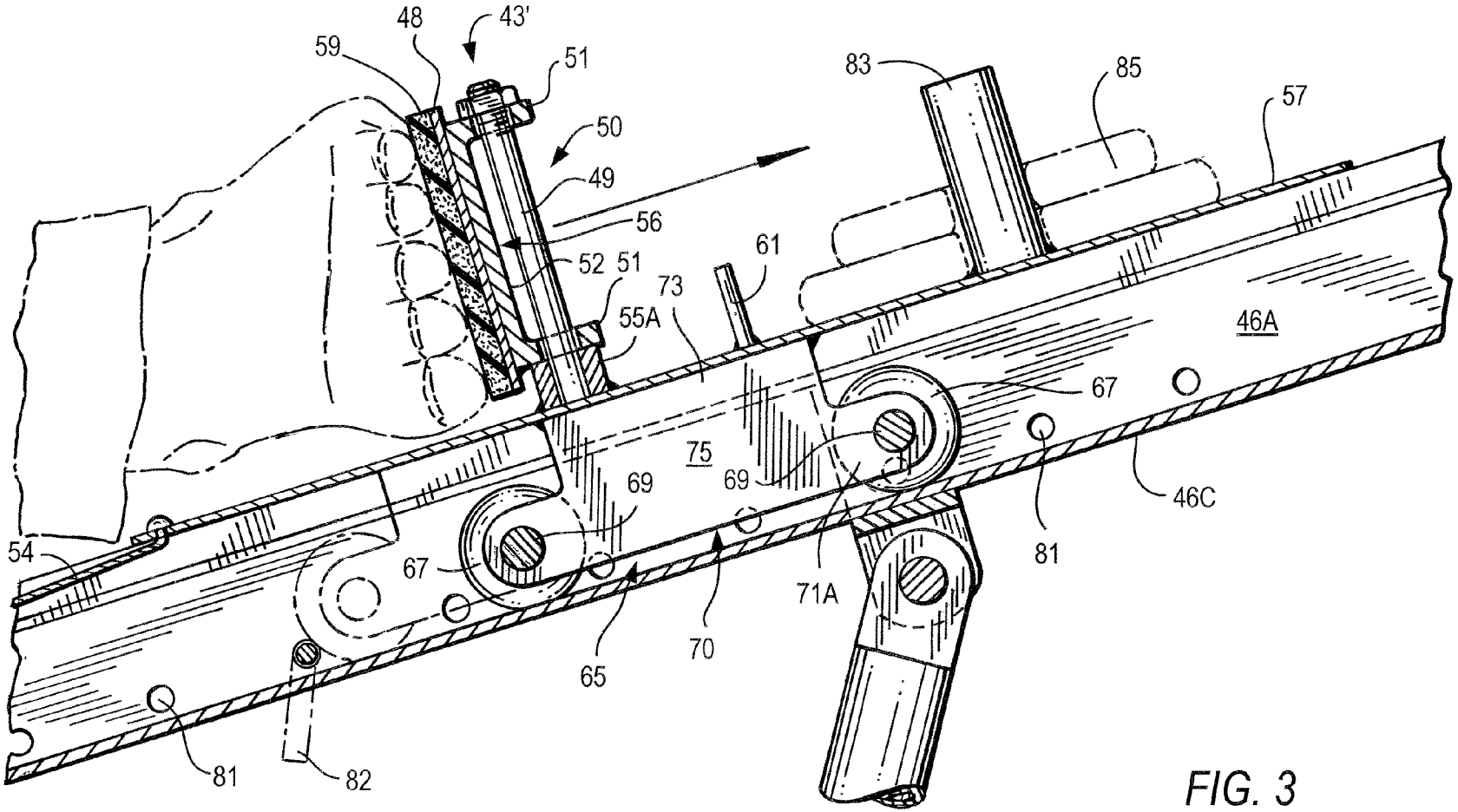
FIG. 3 is a cross-sectional view taken along 3-3 of FIG. 2.

As best shown in FIGS. 2 and 3, housing 47 is defined by an elongated bracket 46 having a pair of fingers 72 disposed in flush contact with the underside of base 45. Fingers 72 are fixed to base 45 by means of a plurality of screw connections 74 running along either side of housing 47. Bracket 46 defines a longitudinally running channel 53 in which a wheel assembly 65 is rollably movable therewithin. Wheel assembly 65 is coupled to plate assembly 43 in order to enable plate assembly 43 to slidably move along the base 45 of platform unit 41. Wheel assembly 65 is defined by a slide unit 70 and two pairs of wheels 67. Slide unit 70 includes a body 75, forward and rear extensions 71*a* and 71*b* and an upper extension 73. Both forward and rearward extensions 71*a* and 71*b* are formed with an opening through which an axle 69 is rotatably received. Wheels 67 are supported at the ends of each of axles 69 in a conventional manner. Significantly, extension 73 of slide unit 70 is received in a longitudinally extending slot 55 formed in base 45 so that wheel assembly 65 is capable of selectively transporting plate assembly 43 along the upper surface of base 45, as described in more detail hereinbelow.

Referring still to FIGS. 2 and 3, as well as to FIG. 1, kick plate assembly 43 includes a rectangularly configured base 57 and a plate unit 43$^{I}$ supported on base 57. Plate unit 43$^{I}$ includes a plate element 48 on which a pedal 59 is overlyingly mounted. Plate unit 43$^{I}$ is pivotally mounted to base 57 by means of a pivot assembly 50. Pivot assembly 50 includes a pivot support 56 and a pivot rod 49 about which pivot support 56 is rotatably movable. Pivot support 56 includes a back 52 fixed to plate 48 of plate unit 43 and forwardly depending finger supports 51. Each of finger supports 51 is formed with an opening through which rod 49 is rotatably received, thereby enabling plate unit 43$^{I}$ to swivably rotate with respect to base 57. As can be appreciated from viewing FIGS. 2 and 3, swivable rotation of plate unit 43$^{I}$ is limited by means of pins 61 upwardly depending from base 57. Pins 51 act as a stop for preventing rotational movement of plate unit 43 beyond a pre-designed angle.

As shown in FIG. 3, kick plate assembly 43 further includes an upwardly depending post 83, spaced forward and substantially away from plate unit 43$^{I}$. Post 83 is used for selectively carrying one or more circular weights 85 in order to increase the resistance in moving or sliding kick plate assembly 43 along platform unit 41.

Still referring to FIGS. 2 and 3, as can be appreciated, kick plate assembly 43 also includes a connecting member 56A radially fixed about the lower part of rod 49 of pivot assembly 50 and fixed along its bottom to base 57 of plate assembly 43. Base 57 in turn is fixed to upper extension 73 of slide unit 70. As a result, when a forward force is applied to pedal 59 of plate unit 43$^{I}$ (by, for example, a foot or some other body appendage), plate assembly 43 is able to slidably move along base 45 of platform unit 41 as wheel assembly 65 rolls within channel 53 of bracket 46.

As shown in FIGS. 2 and 3, housing 47 of platform unit 41 includes a pair of sidewalls 46A and 46B, at least one of which having a series of aligned, spaced apart holes 81. Holes 81 are designed for selectively receiving a pin element 82 in order to provide a rearward stop for wheel assembly 65. In other words, depending on how far back it is desired for kick plate assembly 43 to return to a particular longitudinal location along platform unit 41, pin element 82 is inserted in one of holes 81 as desired.

Continuing now with FIGS. 1 and 2, support frame 30 includes an adjustment bar 31 pivotally depending from platform unit 41 and a pair of adjustment arms 33 slidably depending from adjustment bar 31. Adjustment bar 31 has a top end 32 that is formed with an extending male member 93. Male member 93 is pivotally received within a female member 91, which depends down from a bottom wall 46C of housing 47. A pivotal connection between male member 93 of adjustment bar 31 and depending female member 91 is thus achieved by means of a pivot pin 95 extending therethrough.

Figures 4, 5:
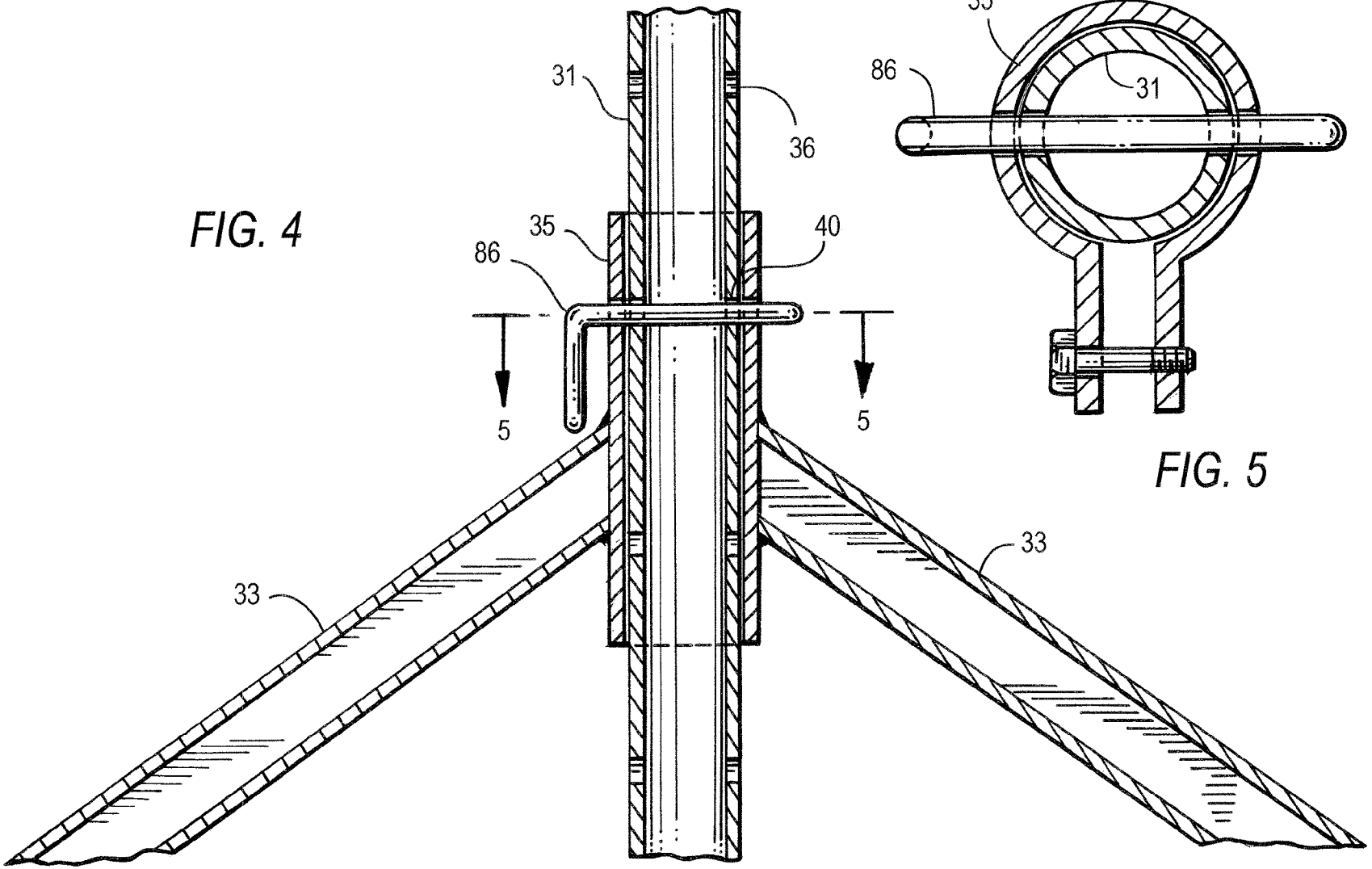
FIG. 4 is a cross-sectional view taken along line 4-4 of FIG. 1.
FIG. 5 is a cross-sectional view taken along 5-5 of FIG. 4.

Adjustment bar 31 includes a sleeve 35 slidably received thereover, as best shown in FIG. 4. Adjustment arms 33 fixedly depend from sleeve 35 in directions away from one another and are pivotally attached at their ends to base unit 13, as described in greater detail hereinafter. Significantly, adjustment bar 31 is provided with a plurality of spaced apart openings 36 running longitudinally therealong. Any of said openings 36 may be aligned with an opening 40 formed in sleeve 35 in order to receive a locking bar 86 (see FIG. 4). Accordingly, sleeve 35 may be slidably moved relative to adjustment bar 31 and then locked in position at a desired height by means of inserting locking bar 86 through opening 40 of sleeve 35 and one of openings 36 of adjustment bar 31. As a result, platform unit 41 may be angularly adjusted in height as desired by the user.

Figure 6:
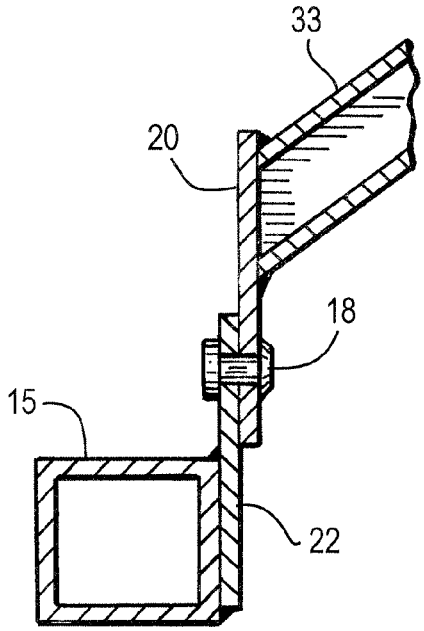
FIG. 6 is a cross-sectional view taken along line 6-6 of FIG. 1.

Referring now to FIGS. 1 and 6, the connection of adjustment arms 33 to base unit 13 is now described. Base unit 13 includes a pair of spaced apart support bars 15 and a cross bar 17 transversely connected between support bars 15 in order to provide base 13 with an "H" shaped configuration. Extending from cross bar 17 in substantially the same plane thereof, and in a direction opposite to that of platform unit 41, is a rectangularly shaped stand 19, on which the user rests one of his or her legs during use of the exercise apparatus of the invention. Stand 19 fixedly supports an upwardly extending cane element 21 that is used to help the user of exercise apparatus 11 support his or her self. Cane element 21 includes a plug shaped base 24 fixed to stand 19, a pole 23 extending upwardly from base 24 and a grip element 25.

With specific reference to FIG. 6, each of arms 33 of support frame 30 includes a downwardly depending leaf element 20 that is pivotally engaged by means of a bolt 18 to a projection 22 upwardly depending from corresponding support bar 15 of base unit 13. This construction enables arms 33 of support frame 30 to rotatably bend relative to support bars 15 when slidably adjusting the height of sleeve 35 relative to adjustment bar 31.

Figure 7:
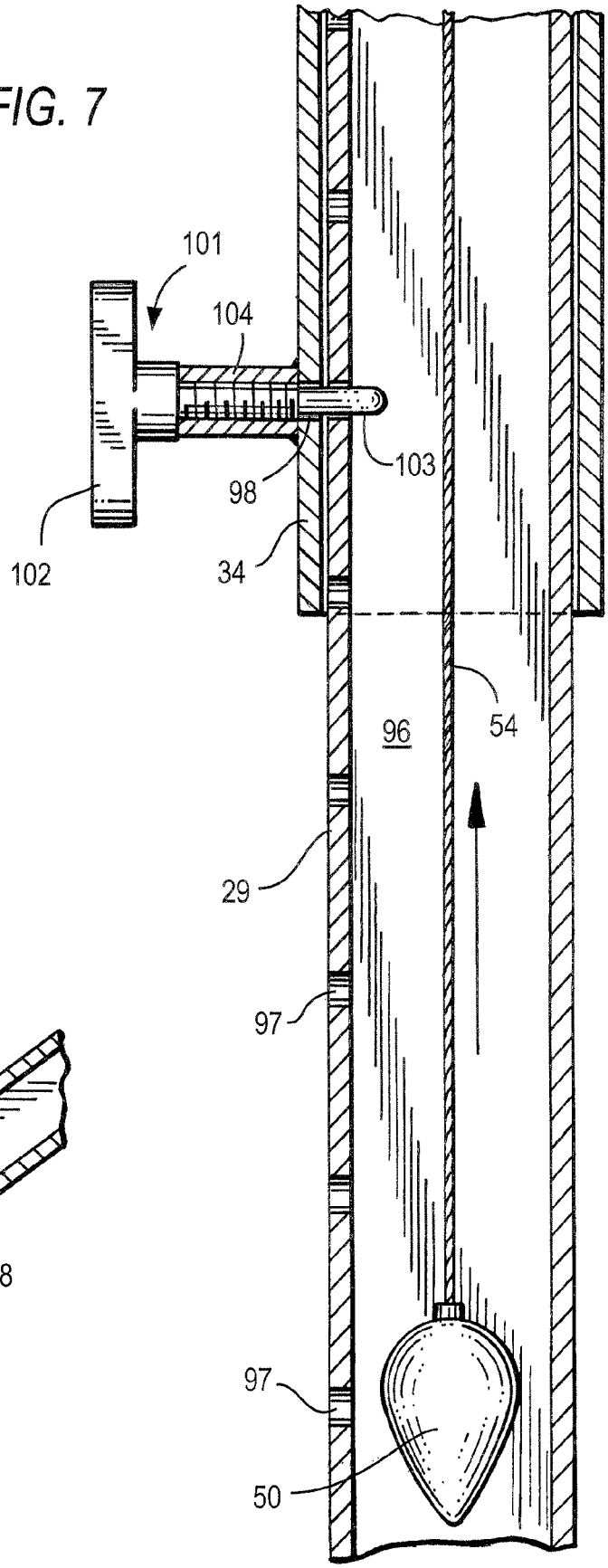
FIG. 7 is a cross-sectional view taken along line 7-7 of FIG. 1.

Reference is now made to FIG. 7 as well as to FIG. 1, both of which illustrate the construction of support unit 27. Support unit 27 includes a vertically disposed post 29, the bottom of which sits on the ground, and a retangularly configured sleeve 34 in which post 29 is slidably received therewithin. Post 29 has a passage 96 running therethrough and includes a plurality of spaced apart holes 97 which may be selectively aligned with an opening 98 formed in sleeve 34 in order to adjust the height of support 27. In particular, a screw element 101 is provided with a rotatable handle or head 102, a body 104 and an extending pin 103. In use, pin 103 of screw element 101 is designed to be received in opening 98 of sleeve 34 and any of holes 97 of post 29 when the selected hole 97 is disposed in aligned position with opening 98. Therefore, by selectively placing pin 103 of screw element 101 within different holes 97 of post 29, the height of support unit 27 may be raised and lowered as desired.

Continuing with FIG. 7, and referring once again to FIG. 3, kick plate assembly 43 is shown provided with a counterweight mechanism in order to ensure that plate assembly 43 is retracted to a position along platform unit 41 adjacent to support unit 27 when no pressure is being applied to pedal 59 of plate unit 43$^{I}$. More specifically, base 57 of kick plate assembly 43 has a rope 54 tied to the rear end thereof. Rope 54 extends through channel 53 of bracket 46, across pulley wheel 99 (see FIG. 15), and down through passage 96 of post 29. Rope 54 has a counterweight 50 fixed at its end (see FIG. 7) that is of a sufficient mass to ensure complete retraction of kick plate assembly 43 along platform unit 41 regardless of the angular position of platform unit 41 relative to support unit 27.

Figure 8:
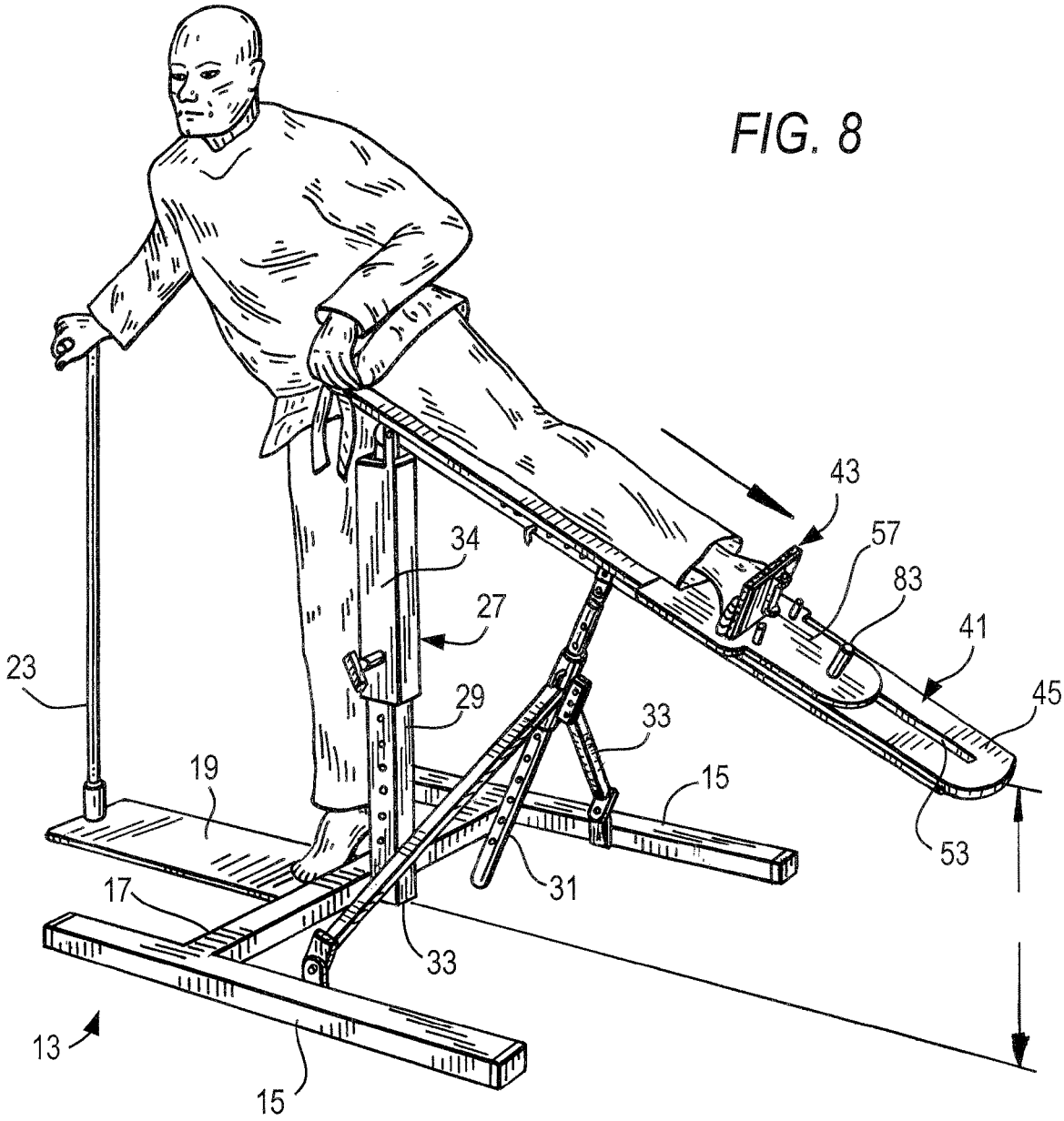

In FIG. 8, exercise apparatus 11 is shown in one configuration in which platform unit 41 extends downwardly at an angle from the top of support unit 27. In FIGS. 9-11, platform 41 is shown in a position in which it is substantially parallel to the floor. FIG. 9 shows the user with his or her leg in a retracted position; FIG. 10 shows the user with his or her leg in an extended position, and FIG. 11 show the user with his or her leg in an alternative extended position.

In FIG. 12, platform unit 41 is shown in a position in which it extends upwardly from the top of relative support unit 27.

Figure 13:
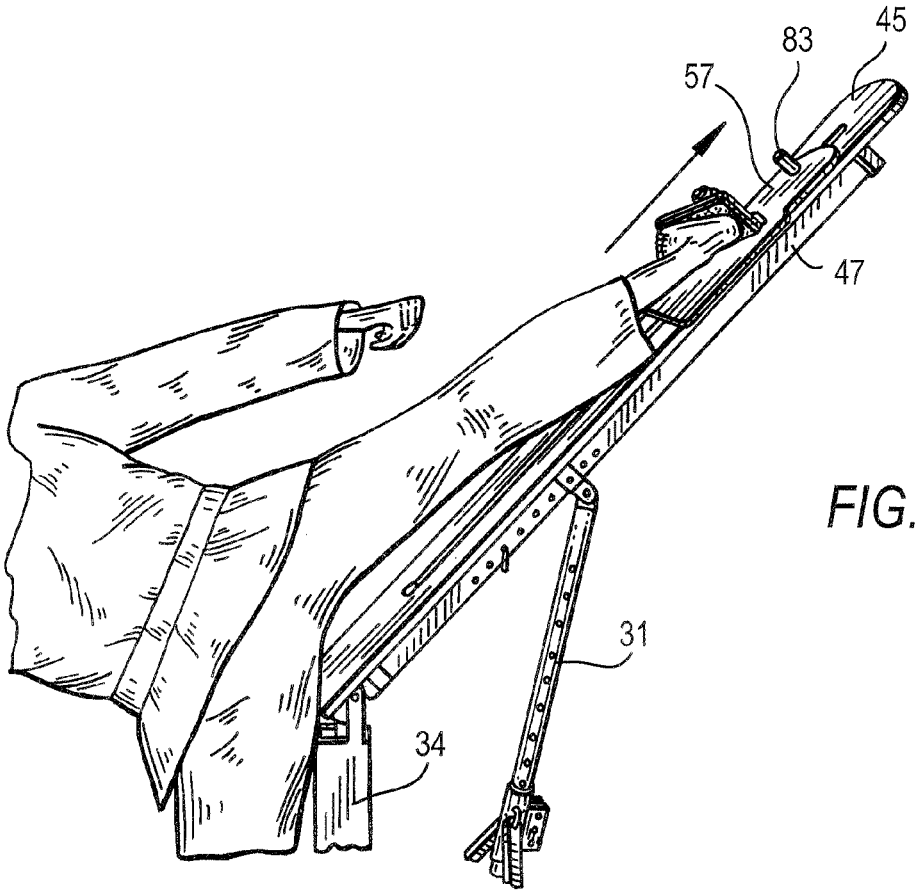

FIG. 13 shows platform unit 41 in the same angular position as in FIG. 12 but with the user having his or her foot extended in a different exercise position.

Figure 14:
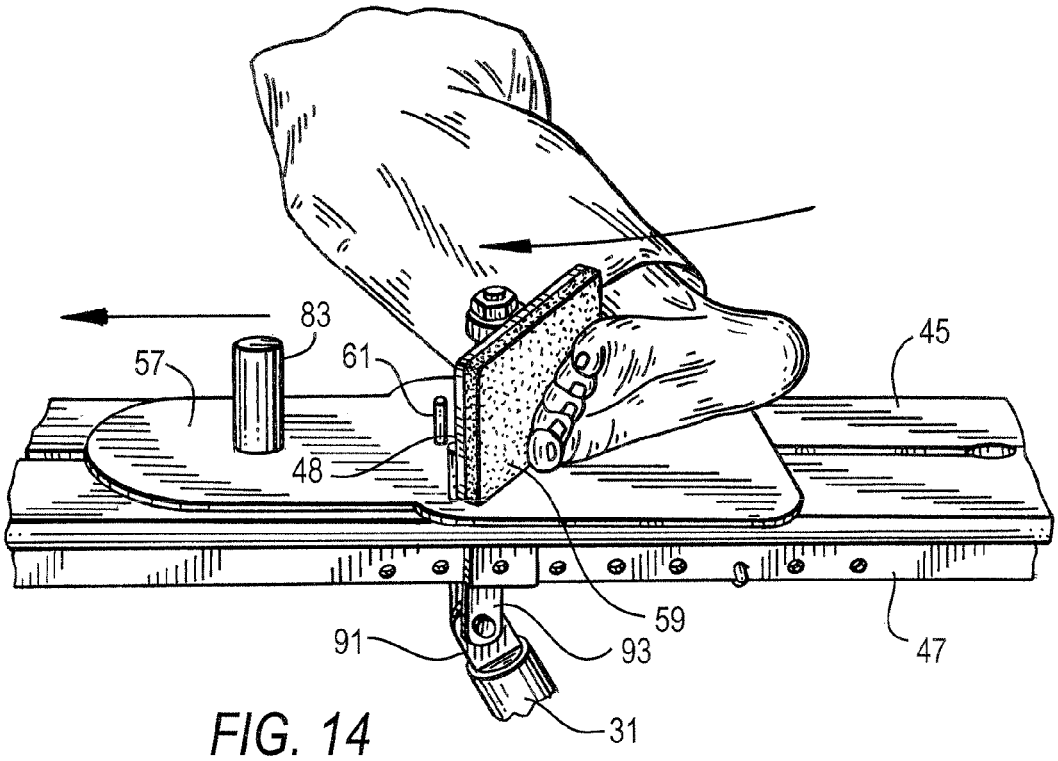

In FIG. 14, the user of exercise apparatus 11 is shown having his or her foot wrapped around pedal 59 of plate unit 43$^{I}$.

Figure 15:
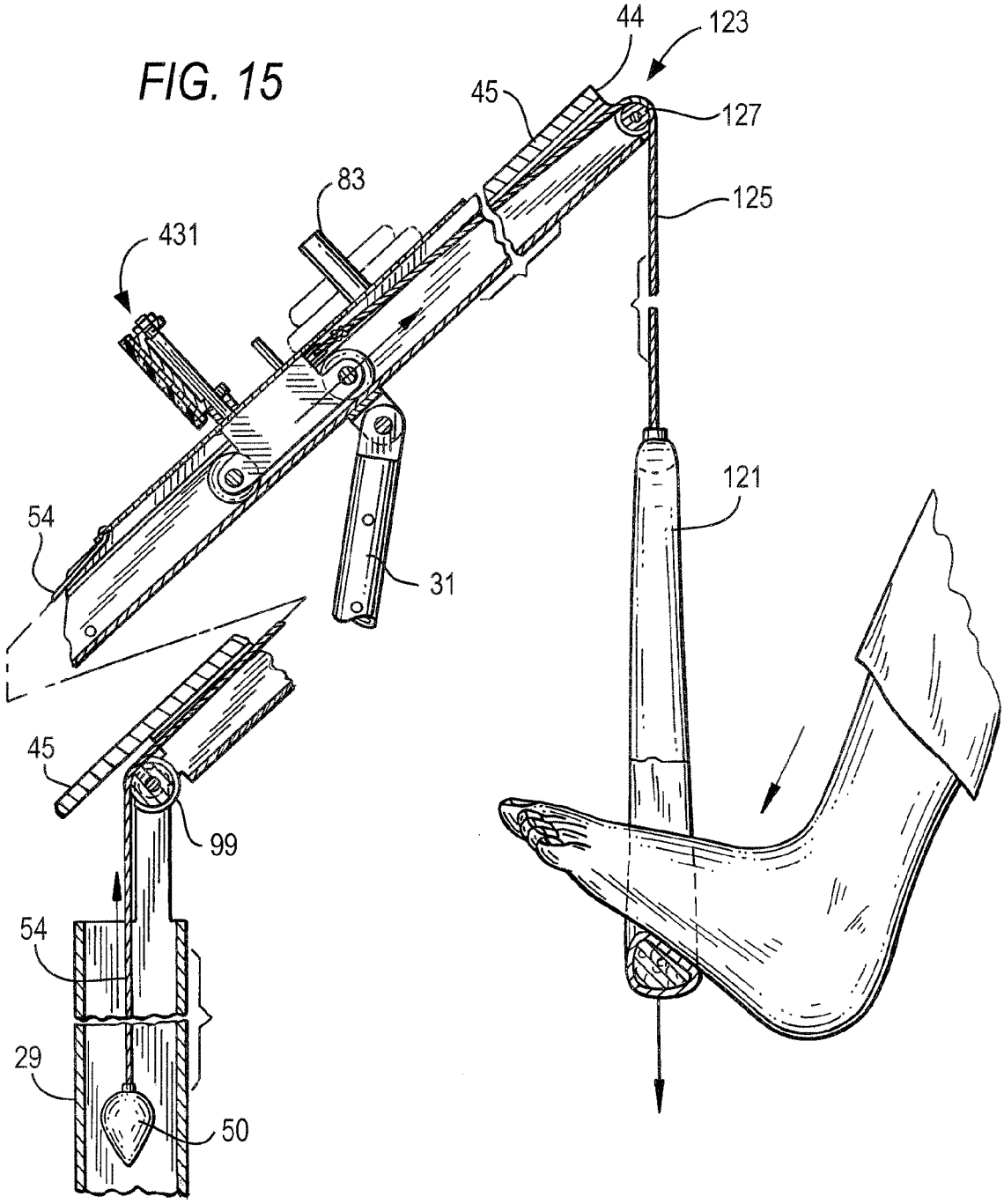
FIG. 15 is a fragmentary elevational view partially in cross-section and showing an alternative embodiment of the inventive exercise apparatus in which a foot supporting loop element is added.

Referring now to FIG. 15, exercise equipment 11 is shown as being modified to include a hanging loop 121 in order to enable a different type of exercise to be carried out. Loop 121 is made of a leather, canvas or rubber material and hangs from the forward end 44 of platform unit 41 by means of a pulley mechanism 123. Pulley mechanism 123 consists of a rope having a first end coupled to slide unit 70 of wheel assembly 65 that is movably retained in channel 53 of housing 47 and a second end fixed to the top of loop 121. Mechanism 123 also includes a pivot wheel 127, which is disposed at forward end 44 of platform unit 41 along which rope 125 is rotatably carried.

Referring now to FIGS. 16-20, there are shown different ways for using exercise apparatus 11 in exercising one's hand or arm.

FIG. 16 shows the pointer and middle fingers of the user pressing against pedal 59 of plate unit 43$^{I}$.

FIG. 17 shows the user with a closed fist pushing against pedal 59 of plate unit 43$^{I}$.

FIG. 18 also shows the fist of the user pressing against pedal 59 of plate unit 43$^{I}$, but in a different rotated position.

FIG. 19 shows the back of one's hand pressing against pedal 59 of plate unit 43$^{I}$.

FIG. 20 shows the side of one's hand pressing against pedal 59 of plate unit 43$^{I}$.

Figure 21:
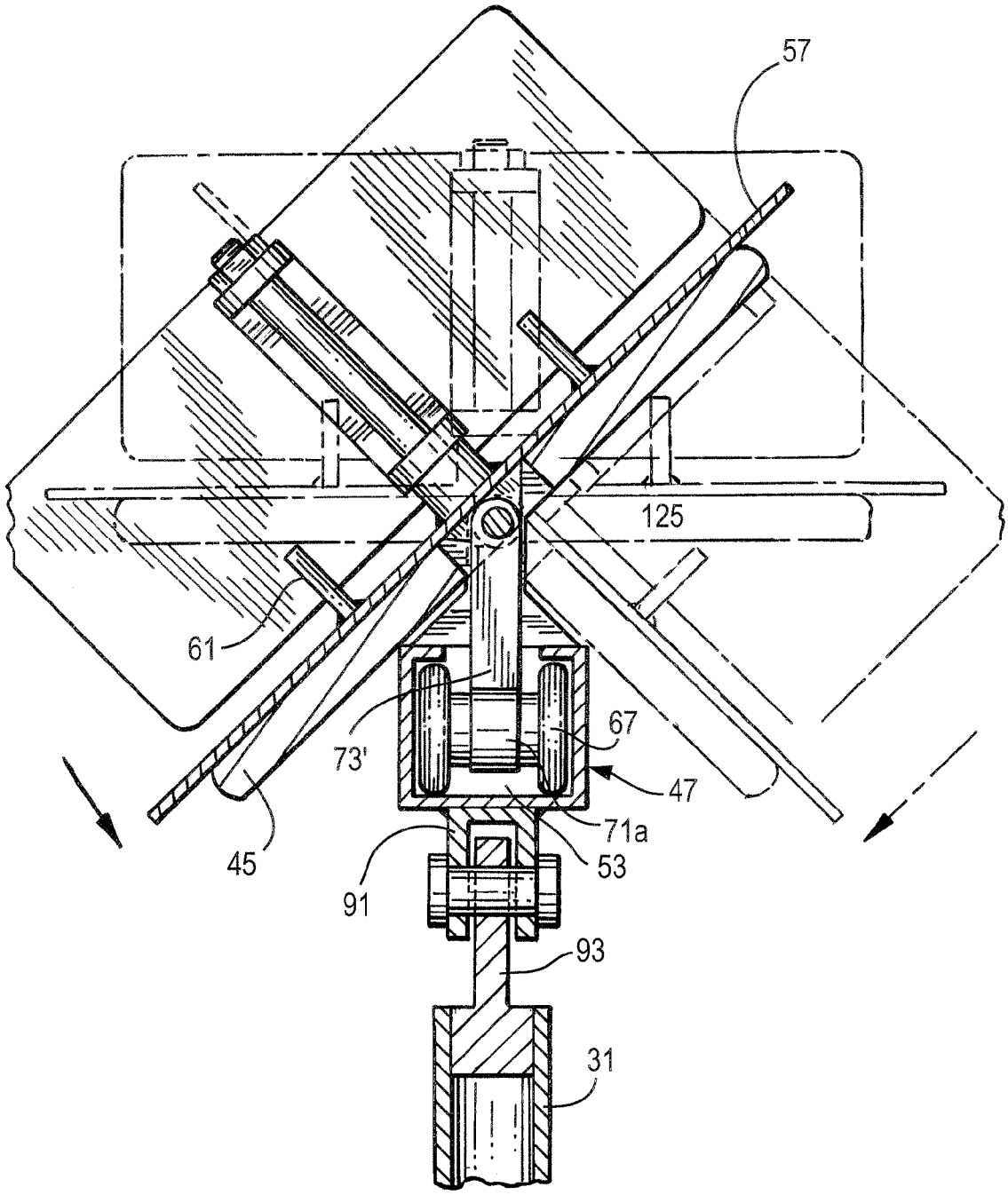
FIG. 21 is a cross-sectional view, similar in part to that of FIG. 2, in which the optional feature of the platform base being aimed pivotal in a lateral direction is shown.

FIG. 21 is similar in part to FIG. 2, but illustrates the option of having base 45 of platform unit 41 being pivotable from side to side in a lateral direction. In this embodiment, slide unit 70 has an upper extension 73' extending well above channel 53 of housing 47 and is pivotally connected to base 45 by means of a longitudinally extending pivot pin 125. This enables base 45 and, in turn, base 57 of kick plate assembly 43 to pivotally rotate to one side or the other in order to provide further options for using exercise apparatus 11.

Figure 22:
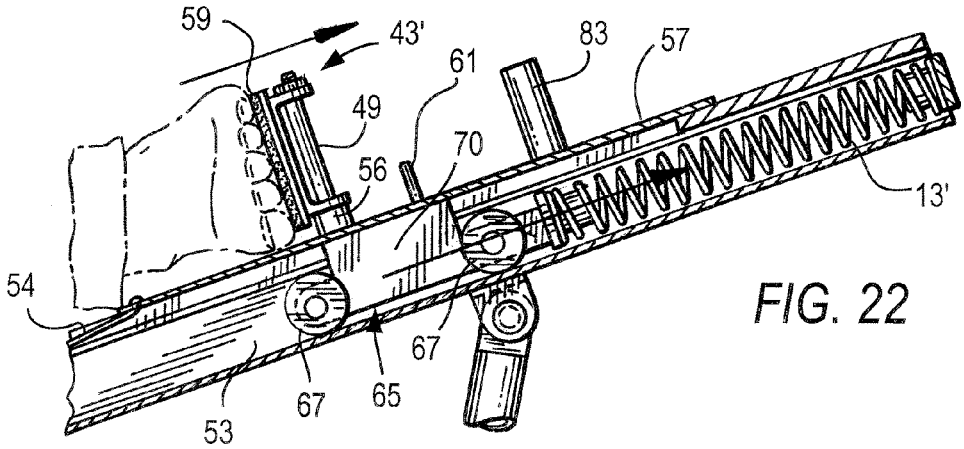
FIG. 22 is a cross-sectional view showing the inside of the platform unit of the inventive apparatus with the optional feature of a spring for providing resistance when pressing against the plate unit.

Referring now to FIG. 22, a further embodiment of the inventive apparatus in which a spring 131 is shown disposed within the forward portion of channel 53 and fixedly attached to the forward end of wheel assembly 65. Spring 131 provides enhanced resistance when pressing against pedal 59 of plate unit 43$^{I}$ during use of the inventive apparatus.

Figure 23:
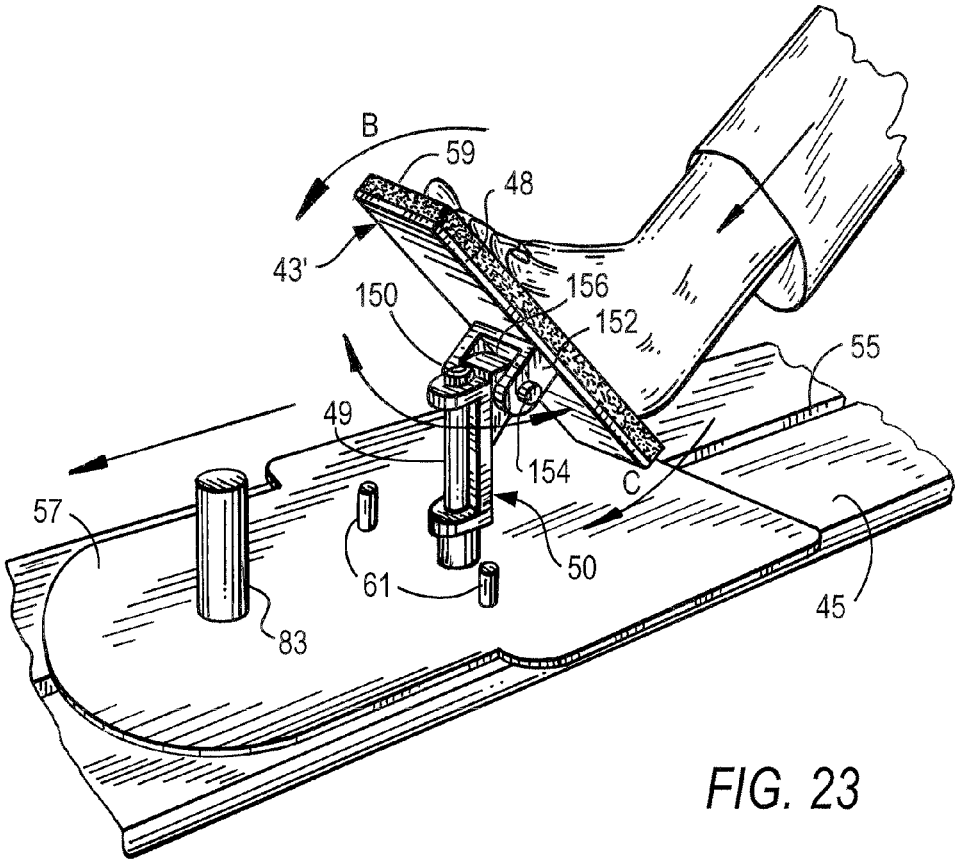
FIG. 23 is a perspective view in elevation showing the optional feature of the plate unit of the inventive apparatus being pivotal in both a lateral rotational direction and a longitudinal rotational direction.

In FIG. 23, the inventive apparatus includes a mechanism for providing selective pivotal movement of plate unit 43 in both a first lateral angular direction, as described and shown in FIGS. 2 and 3, and in a second longitudinal angular direction, as indicated by arrows B and C. As shown, attached to pivot assembly 50, is a second pivot assembly 150 defined by a pair of prong elements 152 and a pivot pin 154. Prong elements 152 depend from a pivot panel 156, which is fixed to plate 48 of plate unit 43$^{I}$. Accordingly, plate unit 43$^{I}$ can pivotally rotate in both longitudinal and lateral rotational directions.

FIG. 24 and FIG. 25 show the inventive apparatus having the optional feature of a pair of wing elements 200 pivotally hinged along platform unit 41. Each of wing elements 200 includes an angularly directed slot or track 202 running in parallel to the outer curved end wall 204. Each of slots 202 slidably receives a post 206 about which the foot of the person exercising can be wrapped in order to perform another type of exercise.

The inventive apparatus eliminates the fear of injury by letting the body stretch naturally. Stretching is accomplished with small controlled increments. It also allows the left and right legs to improve flexibility at the same rate. Being able to control the height and angle of movement gives the user much more confidence to obtain maximum flexibility in a much shorter period of time.

It will thus be seen that the objects set forth above, among those made apparent from the description, are attained by the construction of the inventive apparatus and the use thereof.

Moreover, the scope of the invention is now defined in the following claims.

The invention claim is:

1. An exercise apparatus comprising:

(a) a longitudinally extending platform;

(b) a support on which said platform is supported off the ground, the support comprising a support bar extending from and pivotally connected to one end of said platform and a support frame extending down from and pivotally connected to said platform at a location away from said one end, said support bar having a height which is selectively and independently adjustable and said support frame having a height which is selectively and independently adjustable; and (c) a substantially vertically directed plate slidably carried along said platform and moveable between a first retracted position and a second extended position therealong in response to a force being applied to said plate by an appendage of an individual;

wherein said support frame includes an adjustment bar extending down from said platform and a pair of arms connected to said adjustment bar and extending angularly downward therefrom and away from one another, said arms being slidably connected to said adjustment bar by means of a sleeve slidably moveable with respect to said adjustment bar and to which said arms are connected at one end thereof.

2. The apparatus of claim 1, wherein said support bar is adjustable in height by means of a sleeve slidably moveable with respect to said support bar.

3. The apparatus of claim 1, wherein said support further includes a base to which the other ends of said arms are pivotally connected.

4. The apparatus of claim 1, wherein said platform is formed with a longitudinally running channel through which a wheel assembly for carrying said plate is transported in response to a force being applied to said plate.

5. The apparatus of claim 1, wherein said plate is pivotally rotatable in at least one of a lateral direction and longitudinal direction.

6. The apparatus of claim 5, wherein said plate is restricted in its lateral rotation movement by means of a stop member.

7. The apparatus of claim 1, further including means for adding resistance to said force being applied to said plate.

8. The apparatus of claim 7, wherein said resistance adding means includes at least one of a spring member and an added weight element.

9. The apparatus of claim 1, further including means for urging said plate towards said retracted position when a force is not applied on said plate.

10. The apparatus of claim 9, wherein said urging means comprises a counterweight mechanism.

11. The apparatus of claim 1, wherein said platform is pivotally rotatable from side to side in a lateral direction.

12. The apparatus of claim 4, further including an appendage supporting loop hanging from said platform and operatively connected to said wheel assembly.

13. The apparatus of claim 1, further including means for urging said plate towards said retracted position when a force is not applied on said plate.

14. The apparatus of claim 1, wherein said plate is pivotally rotatable in at least one of a lateral direction and longitudinal direction.

15. The apparatus of claim 1, further including a mechanism for selectively adjusting the angular direction which said platform extends in a vertical plane and a first locking mechanism for selectively locking said platform in varying angular directions.

16. The apparatus of claim 15, wherein said angular direction mechanism comprises said support frame.

17. The apparatus of claim 11, further including a locking mechanism for selectively locking said platform in varying pivotally rotated directions.

* * * * *